US005674674A

United States Patent [19]

Edwards et al.

[11] Patent Number: 5,674,674

[45] Date of Patent: Oct. 7, 1997

[54] LOW STAINING GREEN SPECTRAL SENSITIZING DYES AND SILVER CHLORIDE EMULSIONS CONTAINING IODIDE

[75] Inventors: James Lawrence Edwards, Rochester; Benjamin Teh-Kung Chen, Penfield; Richard Lee Parton, Webster, all of N.Y.

[73] Assignee: Eastman Kodak Company, Rochester, N.Y.

[21] Appl. No.: 580,732

[22] Filed: Dec. 27, 1995

[51] Int. Cl.[6] ..... G03C 1/18; G03C 1/035

[52] U.S. Cl. ..... 430/567; 430/588; 430/605

[58] Field of Search ..... 430/567, 588, 430/605

[56] References Cited

U.S. PATENT DOCUMENTS

| | | | |
|---|---|---|---|
| 3,424,586 | 1/1969 | Gotze | 430/588 |
| 3,865,598 | 2/1975 | Shiba et al. | 430/567 |
| 4,269,927 | 5/1981 | Atwell | 430/217 |
| 5,091,298 | 2/1992 | Parton et al. | 430/567 |
| 5,314,798 | 5/1994 | Brust et al. | 430/567 |
| 5,316,904 | 5/1994 | Parton et al. | 430/567 |
| 5,354,651 | 10/1994 | Parton | 430/567 |
| 5,413,904 | 5/1995 | Chang et al. | 430/569 |
| 5,480,886 | 1/1996 | Yamazaki et al. | 430/264 |
| 5,550,013 | 8/1996 | Chen et al. | 430/567 |
| 5,605,789 | 2/1997 | Chen et al. | 430/567 |

FOREIGN PATENT DOCUMENTS

| | | | |
|---|---|---|---|
| 0 178 097 | 9/1984 | European Pat. Off. . | |
| 508795 | 10/1992 | European Pat. Off. . | |
| 0 599 381 | 6/1994 | European Pat. Off. . | |
| 599382 | 6/1994 | European Pat. Off. . | |
| 599383 | 6/1994 | European Pat. Off. . | |
| 599384 | 6/1994 | European Pat. Off. . | |
| 0 658 805 | 6/1995 | European Pat. Off. . | |
| 3249141 | 10/1988 | Japan | 430/588 |
| 1197740 | 8/1989 | Japan | 430/588 |

*Primary Examiner*—Lee C. Wright
*Attorney, Agent, or Firm*—Paul A. Leipold

[57] ABSTRACT

The invention relates to a photographic element comprising a silver halide emulsion wherein at least one layer contains a silver chloroiodide emulsion containing at least 95 mole percent chloride and contains a sensitizing dye of the following general formula (I):

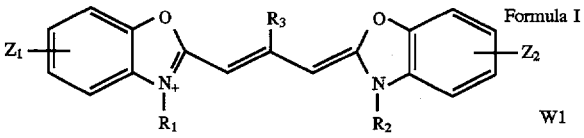

wherein:

Z1 represents a halogen, a cyano group, an amide substituted aromatic group, or a heteroaromatic group that is directly appended to the benzene ring shown or an aromatic group that is attached through an amide linking group and Z2 represents a substituted or unsubstituted alkyl group, substituted or unsubstituted alkoxy group, cyano group, a substituted or unsubstituted amide group, a substituted or unsubstituted carbamoyl group, halogen, an amide substituted aromatic group, or a heteroaromatic group that is directly appended to the benzene ring shown or an aromatic group that is attached through an amide linking group and W1 is one or more ions as needed to balance the charge on the molecule and R1 and R2 are, independently, substituted or unsubstituted alkyl group and R3 is H or a substituted or unsubstituted lower alkyl group or a substituted or unsubstituted aryl.

18 Claims, No Drawings

LOW STAINING GREEN SPECTRAL SENSITIZING DYES AND SILVER CHLORIDE EMULSIONS CONTAINING IODIDE

FIELD OF THE INVENTION

This invention relates to silver halide photographic elements. The photographic element has silver chloride emulsions which contain small amounts of iodide and are sensitized with cyanine dyes.

BACKGROUND OF THE INVENTION

Silver halide photography usually involves the exposure of silver halide photographic element with light in order to form a latent image that is developed during photographic processing to form a visible image. Silver halide is intrinsically sensitive only to light in the blue region of the spectrum. In order to sensitize the silver halide to light other than the blue region, sensitizing dyes are used in the silver halide emulsion. Sensitizing dyes are chromophoric compounds (usually cyanine dye compounds). Their usual function is to be adsorbed to the silver halide and then to absorb light (usually other than blue light) and transfer that energy to the silver halide grain thus, rendering the silver halide sensitive to radiation of a wavelength other than the blue intrinsic sensitivity. However, sensitizing dyes can also be used to augment the sensitivity of silver halide in the blue region of the spectrum.

Generally a sensitizing dye should wash out of the photographic element during processing. Any retained sensitizing dye contributes to Dmin and is often referred to as sensitizing dye stain. Dye stain adversely affects the image recorded in the photographic material and has been a source of concern for many years. The problem of retained sensitizing dye stain has been aggravated by the advent of new emulsions, such as tabular emulsion grains, which have more surface area and require higher dye levels and accordingly tend to give higher levels of dye stain. Additionally, the use of high chloride emulsions makes preferable the use of sensitizing dyes having enhanced adsorption to silver halide since sensitizing dyes tend to be inherently less well adsorbed to silver chloride emulsions.

Because sensitizing dyes are less well absorbed to silver chloride, efforts to design green sensitizing dyes which show improved aggregation on silver chloride have been the subject of much research over the last several years since the introduction of high chloride emulsions in the 1980's. This effort has led to the development of many new dyes which show enhanced sensitivity on silver chloride but frequently at the expense of increased dye stain. Thus increasing the dye's tendency to aggregate can also lead to higher levels of dye stain.

High chloride emulsions are also often subjected to rapid processing, which can further aggravate dye stain problems since the dyes in the photographic element have less time to wash out or be bleached in the development or bleach-fix process.

Modern color photographic printing papers employ silver halide emulsions having a high chloride content in order to obtain rapid processing rates relative to silver chlorobromide emulsions.

In order to reduce dye stain, stain-reducing agents, such as bis-triazine stilbene compounds, also known as optical brighteners, have been used to reduce dye stain. These compounds, however, are expensive and can be difficult to incorporate in the hydrophilic layers of photographic materials. Another method for reducing dye stain in some cases is to incorporate certain substituents into the dye molecule to reduce dye stain. For example, dyes containing N,N'-2-hydroxy-3-sulfopropyl nitrogen substituents (U.S. Pat. No. 3,424,586) are generally less retained than the corresponding dyes with 3-sulfopropyl groups. Other stain-reducing nitrogen substituents have also been disclosed such as the 2-sulfoethylcarbamoylmethyl groups disclosed in U.S. Pat. No 5,091,298.

Although the foregoing dye structure modifications can be effective at reducing dye stain, they have not eliminated the problem. In addition, there is an important class of green spectral sensitizers for which it is not possible to use these types of stain- reducing nitrogen substituents. In this class are benzoxazole dyes, which are commonly used to afford green sensitization in many photographic products such as color negative and reversal films, and color paper.

Green sensitizing dyes of the types described in European Application Numbers 92303190.9, 93203191.7, 93203192.5, and 93203193.3 have been shown to give reduced dye stain, even in the absence of the stain-reducing agents in the developer. However, many of these low-stain dyes are not efficient sensitizers on high chloride emulsions even those which also contain small amounts of bromide (i.e., less than 2 mole percent).

Shiba et al in U.S. Pat. No. 3,865,598 describes the effect of improved green dye adsorption of J-band sensitizers obtained by adding small amounts of iodide to silver chlorobromide emulsions. Shiba states (col. 2, line 10) that "silver chloride emulsions are not suitable as silver halide emulsions for the green layer" . . . having "the fault that development proceeds too rapidly and the emulsion is easily fogged as compared to the silver chlorobromide emulsion."

Shiba's invention is based upon the addition of aqueous potassium iodide to a preformed silver chlorobromide emulsion. He states (col. 3, line 56) that the preferred amount of iodide added is 0.5 to 10 mole percent. Less than 0.5 mole percent iodide results in a small effect and more than 10 mole percent results in low contrast (col. 4, line 6).

Problem to be Solved by the Invention

There remains a need for improved sensitization. There is a particular need for improved sensitization of chloroiodide emulsions with green sensitizing dyes to form emulsions of high photographic sensitivity and low stain.

SUMMARY OF THE INVENTION

It is an object of the invention to overcome disadvantages of a prior green sensitization of chloroiodide emulsions.

The object of the invention is to provide a green light sensitive silver halide emulsion that can be rapidly processed in color developers and which has high photographic sensitivity and low stain.

It is another object of the invention to provide improved sensitization of chloroiodide emulsions.

It is a further object to provide high sensitivity with classes of dyes not previously suitable for green sensitization.

These and other objects of the invention generally are accomplished by providing a photographic element comprising a silver halide emulsion wherein at least one layer contains a silver chloroiodide emulsion containing at least 95 mole percent chloride and contains a sensitizing dye of the following general formula (I):

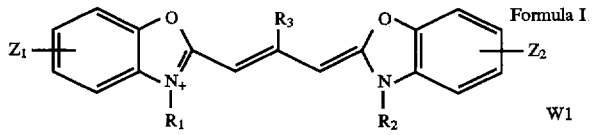

wherein:

Z1 represents a halogen, a cyano group, an amide substituted aromatic group, or a heteroaromatic group that is directly appended to the benzene ring shown or an aromatic group that is attached through an amide linking group and Z2 represents a substituted or unsubstituted alkyl group, substituted or unsubstituted alkoxy group, cyano group, a substituted or unsubstituted amide group, a substituted or unsubstituted carbamoyl group, halogen, an amide substituted aromatic group, or a heteroaromatic group that is directly appended to the benzene ring shown or an aromatic group that is attached through an amide linking group and W1 is one or more ions as needed to balance the charge on the molecule and R1 and R2 are, independently, substituted or unsubstituted alkyl group and R3 is H or a substituted or unsubstituted lower alkyl group or a substituted or unsubstituted aryl.

In a preferred form of the invention, the emulsion comprises a radiation sensitive emulsion comprised of a dispersing medium and silver chloroiodide grains wherein the silver chloroiodide grains are comprised of three pairs of equidistantly spaced parallel {100} crystal faces and contain from 0.05 to 1 mole percent iodide, based on total silver, with maximum iodide concentrations located nearer the surface of the grains than their center.

Advantageous Effect of the Invention

The invention has the advantage that the green light sensitive silver chloroiodide emulsion exhibits high photographic sensitivity and low stain. The dyes of the invention are low staining, as well as of reasonable cost. Further, the photographic element of the invention is not required to contain dye stain removers in the photographic element or in the developing bath. In the alternative the stain remover may be significantly reduced from what is in conventional processing solutions. Such dye stain removers increase cost, as well as being difficult to incorporate and sometimes having undesirable photographic effects on the element. These and other advantages will be apparent from the description below.

DETAILED DESCRIPTION OF THE INVENTION

We have described in U.S. Ser. No. 08/362,283 of Chen et al filed Dec. 22, 1994 a method for the introduction of iodide into the silver chloride emulsion which gives improved sensitivity and does not increase fog or lower contrast which overcomes Shiba's shortcomings.

We have found that many low staining dyes, some of which are described in European Application Numbers 92303190.9, 93203191.7, 93203192.5, and 93203193.3 can afford excellent sensitizing efficiency when they are used to sensitize an emulsion having a high chloride and low iodide content. This dye and emulsion combination can be used to afford a silver halide photographic elements with excellent sensitivity and that can be processed rapidly and with reduced levels of stain reducing compounds such as Phorwite REU in the color developer solution.

In the present application, the term "aromatic" refers to aromatic rings as described in J. March, Advanced Organic Chemistry, Chapter 2 (1985, publisher John Wiley & Sons, New York, N.Y.). Examples of aromatic groups are phenyl, 3-hydroxyphenyl, 4-carbamoylphenyl, etc. Heteroaromatic refers to an aromatic group that contains a heteroatom (e.g., pyrrole-1-yl group, furan-2-yl group, etc.).

Reference in this application to any chemical "group" (such as alkyl group, aryl group, heteroaryl group, and the like) includes the possibility of it being both substituted or unsubstituted (for example, alkyl group and aryl group include substituted and unsubstituted alkyl and substituted and unsubstituted specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition.

As already mentioned, Z1 and Z2 may represent an aromatic group that is attached through an amide linking group, where the substituent can be attached to either end of the linking group, e.g., Z1-NH—CO'— or Z1-CO—NH—. The linking group can be substituted with aromatic or nonaromatic groups, e.g. methyl.

Examples of Z1 and Z2 include a pyrrole-1-yl group, furan-2-yl group, thiophene-2-yl group, benzencarboxamido group, 4-carbamoylphenyl group and pyrrolecarboxamido group such as shown below:

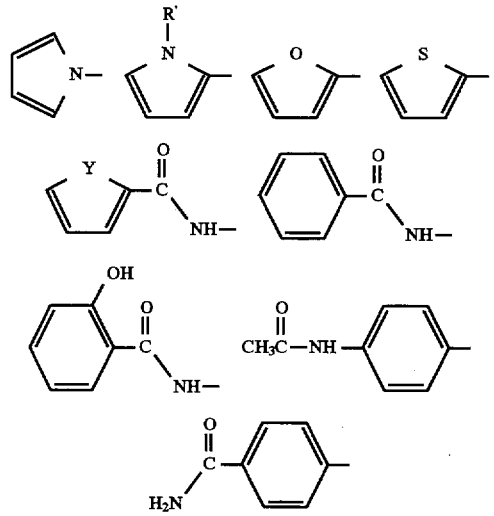

where R', is hydrogen, an alkyl group (for example, methyl, ethyl or 2-hydroxyethyl), or an aryl group (for example, phenyl or 4-hydroxyphenyl), and Y can be N-R', O, S.

R3 is H or a substituted or unsubstituted lower alkyl group (e.g., methyl, ethyl) or a substituted or unsubstituted aryl (e.g., phenyl).

Preferably, R1 and R2 are both alkyl groups; for example, both may be 1–8 (or 1 to 4) carbon alkyl groups, and may be the same or different. At least one of R1 or R2 is preferably substituted by an acid or acid salt group, and preferably both R1 and R2 may be substituted by an acid or acid salt group. Acid salt groups include carboxy, sulfo, phosphato, phosphono, sulfonamido, sulfamoyl, or acylsulfonamido (groups such as —CH2—CO—NH—SO2—CH3) groups. Note that reference to acid or acid salt groups are used to define only the free acid groups or their corresponding salts, and do not include esters where there is no ionizable or ionized proton. Particularly preferred are the carboxy and sulfo groups (for example, 3-sulfobutyl, 4-sulfobutyl, 3-sulfopropyl, 2-sulfoethyl, carboxymethyl, carboxyethyl, carboxypropyl and the like).

W1 is one or more ions as needed to balance the charge on the molecule, since R1 and R2 are preferably both substituted by an acid or acid salt group, W1 will typically be a cation. Examples of suitable cations include sodium, potassium, and triethylammonium. While it is preferred that Z1 and Z2 be the only substituents on their benzene rings, it is also possible that rings may be further substituted with other substituents that do not affect the sensitizing efficiency of the invention compounds. Typical of such substituents would be alkyl or methoxy groups.

Substituents on any of the specified groups defined above that can be substituted (including any of those substituents described for Z1 or Z2) can include substituents such as halogen (for example, chloro, fluoro, bromo), alkoxy (particularly 1 to 10 carbon atoms; for example, methoxy, ethoxy), substituted or unsubstituted alkyl (particularly of 1 to 10 carbon atoms, for example, methyl, trifluoromethyl), amido or carbamoyl (particularly of 1 to 10 or 1 to 6 carbon atoms), alkoxycarbonyl (particularly of 1 to 10 or 1 to 6 carbon atoms), and other known substituents, and substituted and unsubstituted aryl ((particularly of 1 to 10 or 1 to 6 carbon atoms) for example, phenyl, 5-chlorophenyl), thioalkyl (for example, methylthio or ethylthio), hydroxy or alkenyl (particularly of 1 to 10 or 1 to 6 carbon atoms) and others known in the art. Additionally, any of the substituents may optionally be non-aromatic.

Examples of Formula I compounds used in photographic elements of the present invention are listed below in Table I:

TABLE 1

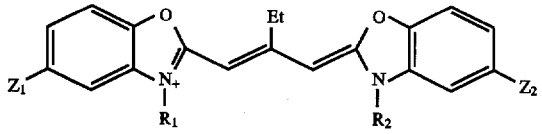

| Dye | Z1 | Z2 | R1,R2 |
|---|---|---|---|
| I-1 | Benzenecarboxamido | F | SP,SP |
| I-2 | Benzenecarboxamido | Cl | SP,SP |
| I-3 | Pyrrole-1-yl | F | SP,SP |
| I-4 | Phenylcarbamoyl | Cl | SP,SP |
| I-5 | p-Acetamidophenyl | Cl | SE,SP |
| I-6 | 3-Hydroxybenzenecarboxamido | Cl | SP,SP |
| I-7 | o-Acetamidophenyl | F | 3SB,SP |
| I-8 | p-Acetamidophenyl | F | SP,SP |
| I-9 | Pyrrolecarboxamido | Cl | SP,SP |
| I-10 | Pyrrolecarboxamido | F | 3SB,SP |
| I-11 | Furancarboxamido | Cl | 4SB,4SP |
| I-12 | Furancarboxamido | F | 4SB,SP |
| I-13 | Cl | Cl | SP,SP |
| I-14 | 2-Hydroxybenzenecarboxamido | F | 3SB,SP |
| I-15 | Thiophenecarboxamido | Cl | 3SB,SP |
| I-16 | F | F | SP,SP |
| I-17 | Furancarboxamido | =Z1 | SE,SE |
| I-18 | 2-Hydroxybenzenecarboxamido | Cl | 3SB,SP |

SP is 3-sulfopropyl, 3SB is 3-sulfobutyl, 4SB is 4-sulfobutyl

Dyes of Formula I can be prepared according to techniques that are well known in the art, such as described in Hamer, *Cyanine Dyes and Related Compounds*, 1964 (publisher John Wiley & Sons, New York, N.Y.) and T. H. James, editor, *The Theory Of the Photographic Process*, 4th Edition, Macmillan, New York, 1977. The synthesis of dyes with furan and pyrrole nuclei is described in European Application Number 93203192.5. The synthesis of amide substituted dyes is described in European Application Number 92303190.9.

The amount of sensitizing dye that is useful to sensitize a silver halide emulsion in the photographic elements of the present invention will typically be from 0.001 to 4 millimoles per mole of silver halide, but is preferably in the range of 0.01 to 1.0 millimoles per mole of silver halide. Optimum dye concentrations can be determined by methods known in the art.

The invention finds its preferred embodiment in the sensitization of silver chloroiodide grains such as formed in U.S. Ser. No. 08/362,283 of Chen et al filed Dec. 22, 1994 which is coowned and coassigned and incorporated by reference herein. The preferred embodiment utilizes grains that are a radiation sensitive emulsion comprised of a dispersing medium and silver chloroiodide grains wherein the silver chloroiodide grains are comprised of three pairs of equidistantly spaced parallel {100} crystal faces and contain from 0.05 to 1 mole percent iodide, based on total silver, with maximum iodide concentrations located nearer the surface of the grains than their center. It is most preferred that the grains have at least one {111} crystal face.

It is preferred that the grain size coefficient of variation of the silver chloroiodide grains is less than 35 percent or most preferably less than 25 percent.

It is also preferred that the invention radiation sensitive emulsion chloroiodide grains contain from 0.1 to 0.6 mole percent iodide, based on total silver, that maximum iodide concentrations in the silver chloroiodide grains are confined to exterior portions accounting for up to 15 percent of the total silver forming the grains, and that the maximum iodide concentrations are located in grain portions forming one or more surfaces of the grains. The iodide forming the grains is generally confined to exterior portions of the grains accounting for up to 50 percent of total silver and is preferably confined to exterior portions of the grains accounting for up to 15 percent of total silver forming the grains.

The radiation sensitive emulsion, of the invention, preferably has chloroiodide grains that include tetradecahedral grains having {111} and {100} crystal faces and contain a reciprocity improving dopant such as iridium dopant.

The radiation sensitive emulsions used in the invention preferably contain as an antifoggant a compound containing a mercapto group bonded to a carbon atom which is linked to an adjacent nitrogen atom in a heterocyclic ring system, such as a 5-mercaptotetrazole including a phenyl substituted 5-mercaptotetrazole, with the phenyl group either being unsubstituted or containing a substituent chosen from among alkoxy, phenoxy, halogen, cyano, nitro, amino, amido, carbamoyl, sulfamoyl, sulfonamido, sulfo, sulfonyl, carboxy, carboxylate, ureido, and carbonyl groups.

The radiation sensitive emulsion also may contain as an antifoggant a quaternary aromatic chalcogenazolium salt wherein the chalcogen is sulfur, selenium, or tellurium such as a benzothiazolium salt or a benzoselenazolium salt.

The emulsion suitable may have as an antifoggant a triazole or tetrazole containing an ionizable hydrogen bonded to a nitrogen atom in a heterocyclic ring system.

Other suitable antifoggants include as an antifoggant a benzotriazole or a tetraazaindene and a dichalcogenide compound comprising an —X—X— linkage between carbon atoms wherein each X is divalent sulfur, selenium, or tellurium.

Photographic elements of the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The invention materials find use in any color paper wherein an improved green sensitive emulsion is desired. The other materials in the color paper may be any of those conventionally utilized. Materials suitable for use in color papers may be found in *Research Disclosure* 37038 of February, 1995. Suitable couplers for use in the invention may be found in Section II of *Research Disclosure* 37038. Emulsions for use in the red and blue layers may be found in those described in Section XV of *Research Disclosure* 37038. Further, the emulsions such as utilized in the invention green layer also may be utilized in the other layers of a color paper in accordance with this invention. Suitable fog inhibitors may be found at Section IV of *Research Disclosure* 37038. A typical format for color paper may be found at Sections VII and VIII of Research Disclosure 37038. Such formats are suitable for forming the three-layered color paper that is in accordance with the invention with the utilization of the green layer of the invention.

A typical multicolor photographic element comprises a support bearing a cyan dye image-forming unit. comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what is often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, identified hereafter by the term "Research Disclosure I." The Sections hereafter referred to are Sections of the Research Disclosure I unless otherwise indicated. All Research Disclosures referenced herein are published by Kenneth Mason Publications, Ltd., Dudley Annex, 12a North Street, Emsworth, Hampshire P010 7DQ, ENGLAND.

The photographic elements of the present invention may also use colored couplers (e.g., to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach acceleraors described in EP 193 389; EP 301 477; U.S. Pat. Nos. 4,163,669; 4,865,956; and 4,923,784 are particularly useful. Also contemplated is the use of nucleating agents, development accelerators or their precursors (U.K. Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g., as described in U.S. Pat. No. 4,366,237; EP 096 570; U.S. Pat. Nos. 4,420,556; and 4,543,323.) Also, the couplers may be blocked or coated in protected form as described, for example in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336, as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat Nos. 4,346,165; 4,540,653 and 4,906,559); with ballasted chelating agents such as those in U.S. Pat. No. 4,994,359 to reduce sensitivity to polyvalent cations such as calcium; and with stain-reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,534; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates,. polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 4 to 10, pH levels of from 4 to 8, and temperatures of from 30° to 80° C., as described in *Research Disclosure I*, Section IV (pages 510–511) and the references cited therein.

The silver halide may be sensitized by sensitizing dyes of formula (I) for a green sensitive emulsion, or other sensitizing dyes, by any method known in the art, such as described in *Research Disclosure I*. Any of the dyes may be added to the emulsion of the silver halide grains which it is to sensitize, and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of Photographic Process*, 4th Edition, Macmillan, New York, 1977. In the case of processing a negative working element, the element is treated with a color developer (that is, one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N- diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The present invention will be further described in the examples below. The structures of comparison dyes C-1 and C-2 are in Table IB.

TABLE IB

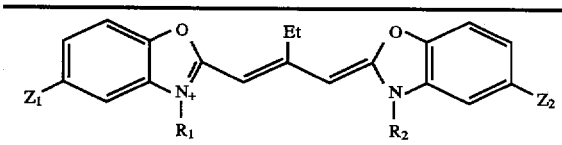

| Dye | Z1 | Z2 | R1,R2 |
|---|---|---|---|
| C-1 Comparison | Phenyl | Cl | 3SB,SP |

TABLE IB-continued

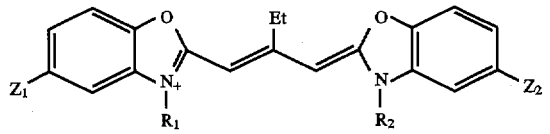

| Dye | Z1 | Z2 | R1,R2 |
|---|---|---|---|
| C-2 Comparison | Acetamido | =Z1 | SP,SP |

Photographic Examples

Emulsion 1:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride were simultaneously run into the reaction vessel with vigorous stirring. The flow rates held constant at 0.50 moles/minute and the silver potential was controlled at 7.2 pAg. The emulsion was washed to remove excess salts. A total of 10 moles of silver chloride emulsion was precipitated. The emulsion having cubic morphology and 0.39 micron average cubic edge length.

Emulsion 2:

Emulsion 2 was prepared in a manner exactly like emulsion 1, except that at point in time equivalent to where 93% of the silver had been added, an aqueous solution containing 0.030 moles of potassium iodide was rapidly added to the reactor.

Chemical and Spectral Sensitization:

Emulsion 1 was sensitized using the following procedure:

An aliquot of emulsion 1 was melted at 40° C. and a methanolic solution containing the equivalent of $2.84\times10^{-4}$M/Ag-M of green spectral sensitizing dye (Table I or IB) was added followed by an aqueous suspension of gold sulfide in the amount of $4.69\times10^{-5}$M/Ag-M. The temperature of the mixture was rapidly raised to 70° C. and held for 30 minutes to effect chemical ripening. After cooling to 40° C., an aqueous solution of 1-(3-acetamidophenyl)-5-mercaptotetrazole was added in the amount of $5.1\times10^{-5}$M/Ag-M. This was followed by the addition of an aqueous solution of potassium bromide in the amount of 1.0 mole percent, which completed the sensitization.

Emulsion 2 was sensitized using the procedure described for emulsion 1 except that the addition of potassium bromide was omitted.

The sensitization process was repeated for each, emulsion and for each of the different sensitizing dyes described in Table 1 and 1B.

Single Layer Coating Evaluation Format:

The emulsions described above were first evaluated in a single emulsion layer coating format using conventional coating preparation methods and techniques. This coating format is described below in detail:

TABLE 2

Single Layer Coating Format

| Layer | Coating Material | Coverage mg/m$^2$ |
|---|---|---|
| Overcoat | Gelatin | 1064. |
| | Gel hardener | 105. |
| Emulsion/Coupler | Emulsion 1 or 2 | 279.0 |
| | Coupler M1 | 430.0 |
| | Solvent S1 | 107.6 |
| | Stabilizer ST1 | 183.0 |
| | Antioxidant AO1 | 43.0. |
| | Gelatin | 1596. |
| Sub-layer | Gelatin | 3192 |
| Resin coated paper support | | |

M-1

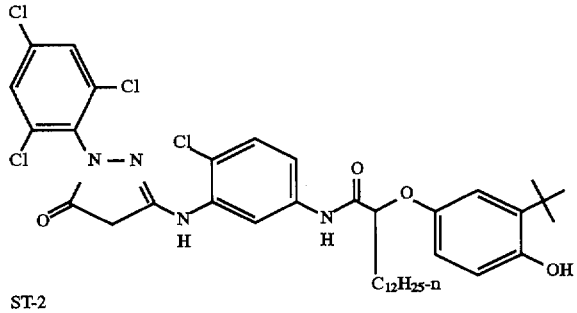

ST-2

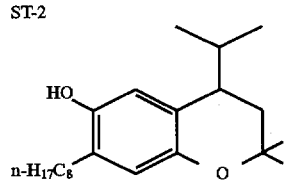

S1 is dibutyl phthlate

AO1 is dioctylhydroquinine

Gel hardener is bis-vinylsulfonylmethyl ether

Once the coated paper samples described above had been prepared, they were evaluated as follows:

The respective single layer color paper samples were exposed to light in a Kodak Model 1B sensitometer with a color temperature of 3000° K. which was filtered with a Kodak Wratten™™ 2C filter. Exposure time was adjusted to 0.1 seconds. The exposures were performed by contacting the paper samples with a neutral stepped exposure tablet having an exposure range of 0 to 3 log-E.

The samples described above were processed in the Kodak Ektacolor RA-4 Color Development™ process. The color developer and bleach-fix formulations are described below in Tables 3 and 4. The chemical development process cycle is described in Table 5.

TABLE 3

The Kodak Ektacolor RA-4 Color Developer:

| Chemical | Grams/Liter |
|---|---|
| Triethanol amine | 12.41 |
| Phorwite REU ™ (Mobay Chemical) | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 ™ (60%) | 1.16 |

TABLE 3-continued

The Kodak Ektacolor RA-4 Color Developer:

| Chemical | Grams/Liter |
|---|---|
| Potassium carbonate | 21.16 |
| Potassium bicarbonate | 2.79 |
| Potassium chloride | 1.60 |
| Potassium bromide | 0.007 |
| Water | to make 1 liter |
| pH @ 26.7° C. is 10.04 +/− 0.05 | |

TABLE 4

The Kodak Ektacolor RA-4 Bleach-Fix consists of:

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |
| pH @ 26.7° C. is 5.5 +/− 0.10 | |

TABLE 5

Kodak Ektacolor RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

TABLE 6

Comparison the Spectral Sensitivities of a Bromochloride vs. and Chloroiodide Emulsion Sensitized with Various Green Spectral Dyes

| Sensitizing Dye | Sensitivity log E Br_Cl Comparison | Sensitivity log E I_Cl Invention | Sensitivity Change log E (I_Cl—Br_Cl) | Dye Stain b* |
|---|---|---|---|---|
| C-1 Comparison | 1.80 | 2.14 | 0.34 | −5.0 |
| C-2 Comparison | 0.00 | 0.00 | 0.00 | −6.3 |
| I-16 | 0.00 | 1.81 | 1.81 | −6.5 |
| I-13 | 0.18 | 1.85 | 1.67 | −6.5 |
| I-2 | 1.72 | 2.03 | 0.31 | −5.8 |
| I-1 | 1.49 | 2.04 | 0.55 | −6.3 |
| I-4 | 1.31 | 1.93 | 0.62 | −6.0 |
| I-5 | 1.18 | 2.04 | 0.86 | −5.3 |
| I-8 | 0.81 | 1.94 | 1.13 | −5.8 |
| I-7 | 0.76 | 1.99 | 1.23 | −5.8 |
| I-18 | 0.00 | 2.16 | 2.16 | −5.2 |
| I-14 | 0.46 | 2.14 | 1.68 | −5.6 |
| I-6 | 1.16 | 2.22 | 1.06 | −5.6 |
| I-15 | 0.40 | 2.04 | 1.64 | −5.5 |
| I-11 | 0.63 | 2.13 | 1.50 | −6.1 |
| I-12 | 0.35 | 1.94 | 1.59 | −6.3 |
| I-17 | 0.09 | 2.18 | 2.09 | −6.2 |

TABLE 6-continued

Comparison the Spectral Sensitivities of a Bromochloride vs. and Chloroiodide Emulsion Sensitized with Various Green Spectral Dyes

| Sensitizing Dye | Sensitivity log E Br_Cl Comparison | Sensitivity log E I_Cl Invention | Sensitivity Change log E (I_Cl—Br_Cl) | Dye Stain b* |
|---|---|---|---|---|
| I-9 | 0.99 | 2.14 | 1.15 | −6.0 |
| I-10 | 0.67 | 2.02 | 1.35 | −6.3 |
| I-3 | 1.48 | 2.11 | 0.63 | −6.2 |

The data shown in Table 6 above compare the spectral responses of the two emulsions as a function of the different Green spectral sensitizing dyes. There are several points to be observed in this table. First is that not all the spectral sensitizing dyes sensitize the bromochloride emulsion, as the range of sensitivities extends from 0 (no sensitization) to 1.8 log E; whereas all of the dyes are shown to efficiently sensitize the chloroiodide emulsion with the lowest of the sensitivities of the chloroiodide emulsion exceeding the best sensitivities of the bromochloride emulsion. The increase in sensitivities can be summarized by comparing the sensitivity difference between the two emulsions and is given in the third column. This sensitivity difference shows a remarkable range of sensitivity increases of the chloroiodide emulsion compared to the bromochloride emulsion of approximately 1.8 log E.

Also shown in Table 6 is the dye stain of the element after being processed in the Kodak Ektacolor RA-4 Color Developer but without the stain reducing agent, Phorwite REU. Dye stain can be characterized by measuring the colorimetric yellowness of the element as green sensitizing dyes when not aggregated on an emulsion are generally yellow in color. The colorimetric term b* is a direct measure of how much sensitizing dye remains in the element after processing, as it is a measure of yellowness. The metric b* is commonly used in the photographic industry, and its definition can be obtained from a variety of sources such as The Principles of Color Technology, 2nd Edition, by F. W. Billmeyer, Jr. and M. Salzman, John Wiley and Sons, New York.

A positive value of b* means that the object (element) appears to the eye as 'yellow', the opposite of blue. A b* value of zero means that the object is neither blue nor yellow, and a negative value for b* indicates the object is less blue, or more yellow. Thus, the more negative the value of b*, the less yellow or bluer the object. In terms of the eyes perception of white, bluer (more negative b*) is preferred.

Since color photographic prints are coated on a reflective support, the absolute color of the white Dmin is limited by the 'blueness' of the support. Also, since sensitizing dyes are generally added in small amounts compared to other chemicals in the photographic element, the amount of change produced by removing the sensitizing dye stain is small, but yet very measureable and very visible to the eye if not removed during processing.

Thus in Table 6, dye C-1 represents the state of the art green sensitizing dye, as it provides the current state of the art bromochloride emulsion with the highest sensitivity. When used to sensitize the chloroiodide emulsion, only a sensitivity increase due to the change in intrinsic sensitivity of the emulsion grain caused by the introduction of iodide into the grain is observed. When processed in a color developer without Phorwite REU, a comparatively 'high' b* stain value is obtained and the element appears 'yellow' when contrasted to a 'white'.

Dye C-2 represents a green spectral sensitizing dye having both the Z1 and Z2 substituents as acetamido groups. This dye, presumably because of its increased aqueous solubility, does not sensitize either the bromochloride or chloroiodide emulsion grain. Because of its increased solubility, the dye stain appears 'bluer'; i.e.: the b* term is more negative.

The inventive dyes remaining in the table, all produce sensitivities on the chloroiodide emulsion which equal or exceed the comparison dyes on the bromochloride emulsion. In addition, these dyes all produce b* values which are more negative than C-1 meaning that their dye stain in Phorwite REU free processes is reduced when compared to C-1.

The preceding examples are set forth to illustrate specific embodiments of this invention and are not intended to limit the scope of the compositions or materials of the invention. It will be understood that variations and modifications can be effected within the spirit and scope of the invention.

We claim:

1. A photographic element comprising a silver halide emulsion wherein at least one layer contains a silver chloroiodide emulsion containing at least 95 mole percent chloride and contains a sensitizing dye of the following general formula (I):

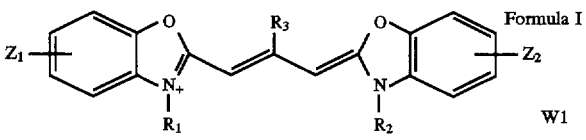

wherein:

Z1 represents a halogen, a cyano group, an amide substituted aromatic group, a heteroaromatic group that is directly appended to the benzene ring shown, or an aromatic group that is attached through an amide linking group and Z2 represents a substituted or unsubstituted alkyl group, substituted or unsubstituted alkoxy group, cyano group, a substituted or unsubstituted amide group, a substituted or unsubstituted carbamoyl group, halogen, an amide substituted aromatic group, or a heteroaromatic group that is directly appended to the benzene ring shown or an aromatic group that is attached through an amide linking group and W1 is one or more ions as needed to balance the charge on the molecule and R1 and R2 are, independently, substituted or unsubstituted alkyl group and R3 is H or a substituted or unsubstituted lower alkyl group or a substituted or unsubstituted aryl and wherein said emulsion comprises chloroiodide grains, wherein the silver chloroiodide grains are comprised of three pairs of equidistantly spaced parallel {100} crystal faces and contain from 0.05 to 1 mole percent iodide, based on total silver, with iodide concentrations confined to exterior portions accounting for up to 50 percent of total silver in said grains.

2. A silver halide photographic element according to claim 1 wherein the iodide content of the emulsion is between 0.1 and 0.6 mole percent based upon total silver.

3. The element of claim 2 wherein said grains comprise at least one {111} crystal face.

4. The element of claim 3 wherein said iodide is confined to up to 15 percent of the exterior portions of the total silver forming the grains.

5. A silver halide photographic element according to claim 1 wherein the grain size of the emulsion is between 0.15 micron and 1.0 micron.

6. A silver halide photographic element according to claim 1 wherein the grain size coefficient of variation of the emulsion is less than 35%.

7. A silver halide photographic element according to claim 2 wherein the emulsion contains less than 5 mole percent bromide.

8. A silver halide photographic element according to claim 1 wherein the emulsion contains iridium.

9. A silver halide photographic element according to claim 1 wherein the emulsion contains a contrast increasing dopant.

10. A silver halide photographic element according to claim 1 wherein R3 is ethyl.

11. A silver halide photographic element according to claim 1 wherein both R1 and R2 are substituted with acid salts.

12. A silver halide photographic element according to claim 1 wherein Z1 and Z2 are halogen.

13. A silver halide photographic element according to claim 1 wherein Z1 and Z2 are chlorine, R3 is ethyl, and R1 and R2 are substituted with an acid salt.

14. A silver halide photographic element according to claim 1 wherein Z1 contains an amide linking group and Z2 is halogen.

15. A silver halide photographic element according to claim 1 wherein Z1 is a pyrole group and Z2 is a halogen.

16. A silver halide photographic element according to claim 1 wherein R3 is ethyl and Z2 is a halogen.

17. The element of claim 1 wherein said element can be processed in a developer not containing stain reducing agent.

18. A method of forming a photographic image comprising providing a photographic element comprising a silver halide emulsion wherein at least one layer contains a silver chloroiodide emulsion containing at least 95 mole percent chloride and contains a sensitizing dye of the following general formula (I):

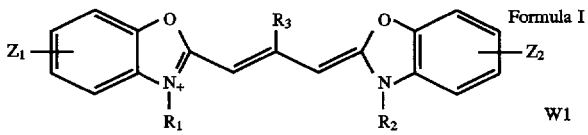

wherein:

Z1 represents a halogen, a cyano group, an amide substituted aromatic group, or a heteroaromatic group that is directly appended to the benzene ring shown or an aromatic group that is attached through an amide linking group and Z2 represents a substituted or unsubstituted alkyl group, substituted or unsubstituted alkoxy group, cyano group, a substituted or unsubstituted amide group, a substituted or unsubstituted carbamoyl group, halogen, an amide substituted aromatic group, a heteroaromatic group that is directly appended to the benzene ring shown or an aromatic group that is attached through an amide linking group and W1 is one or more ions as needed to balance the charge on the molecule and R1 and R2 are, independently, substituted or unsubstituted alkyl group and R3 is H or a substituted or unsubstituted lower alkyl group or a substituted or unsubstituted aryl, exposing said element to light, and developing in a developer that does not contain stain reducing agent and wherein said emulsion comprises chloroiodide grains, wherein the silver chloroiodide grains are comprised of three pairs of equidistantly spaced parallel {100} crystal faces and contain from 0.05 to 1 percent iodide, based on total silver, with iodide concentrations confined to exterior portions accounting for up to 50 percent of total silver in said grains.

* * * * *